US012753974B2

(12) United States Patent
Kim

(10) Patent No.: US 12,753,974 B2
(45) Date of Patent: Oct. 6, 2026

(54) COOLING MODULE

(71) Applicant: Hanon Systems, Daejeon (KR)

(72) Inventor: Young Sam Kim, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 70 days.

(21) Appl. No.: 18/838,919

(22) PCT Filed: Feb. 16, 2023

(86) PCT No.: PCT/KR2023/002304
§ 371 (c)(1),
(2) Date: Aug. 15, 2024

(87) PCT Pub. No.: WO2023/177100
PCT Pub. Date: Sep. 21, 2023

(65) Prior Publication Data

US 2025/0189231 A1 Jun. 12, 2025

(30) Foreign Application Priority Data

Mar. 18, 2022 (KR) ..... 10-2022-0033710

(51) Int. Cl.
*F28D 1/04* (2006.01)
*F28D 21/00* (2006.01)

(52) U.S. Cl.
CPC .... *F28D 1/0435* (2013.01); *F28D 2021/0084* (2013.01); *F28D 2021/0091* (2013.01)

(58) Field of Classification Search
CPC ..... F28D 1/04; F28D 1/0435; F28D 21/00; F28D 2021/0084; F28D 2021/0094;
(Continued)

(56) References Cited

U.S. PATENT DOCUMENTS 5,046,554 A * 9/1991 Iwasaki ..... B60K 11/04 165/44

FOREIGN PATENT DOCUMENTS

JP 2016147559 A 8/2016
JP 2017160816 A 9/2017
(Continued)

OTHER PUBLICATIONS

International Search Report issued in PCT/KR2023/002304 on May 23, 2023.

*Primary Examiner* — Harry E Arant
(74) *Attorney, Agent, or Firm* — NORTON ROSE FULBRIGHT US LLP

(57) ABSTRACT

The present invention relates to a cooling module including a first radiator, and a second radiator stacked and disposed at an upstream side of the first radiator based on a flow direction of cooling air, in which the first radiator includes a main inlet port connected to an engine so that a coolant is introduced through the main inlet port, a main discharge port through which the coolant is discharged, an auxiliary discharge port connected to a third radiator, which is installed at a position that does not overlap the first radiator and the second radiator in the flow direction of the cooling air, so that the coolant is discharged through the auxiliary discharge port, and an auxiliary inlet port through which the coolant is introduced, such that the first radiator may be easily connected to the third radiator, which may improve cooling performance.

19 Claims, 11 Drawing Sheets

(58) Field of Classification Search
CPC ... F28D 2021/0091; F01P 11/08; F01P 11/02; F01P 11/04
See application file for complete search history.

(56) References Cited

FOREIGN PATENT DOCUMENTS

| | | | | | |
|---|---|---|---|---|---|
| KR | 20130054048 | A | | 5/2013 | |
| KR | 20180023244 | A | | 3/2018 | |
| KR | 20190051934 | A | * | 5/2019 | ..... F25B 6/04 |
| KR | 20190075216 | A | * | 7/2019 | ..... B60K 11/04 |
| KR | 102205847 | B1 | | 1/2021 | |

* cited by examiner

COOLING MODULE

CROSS REFERENCE TO RELATED APPLICATIONS

This patent application is a national phase under 35 U.S.C. § 371 of International Patent Application No. PCT/KR2023/002304 filed Feb. 16, 2023, which claims the benefit of priority from Korean Patent Application No. 10-2022-0033710 filed Mar. 18, 2022, each of which is hereby incorporated herein by reference in its entirety for all purposes.

TECHNICAL FIELD

The present invention relates to a cooling module in which a plurality of heat exchangers for cooling an engine of a vehicle and cooling an air conditioner refrigerant are stacked and coupled.

BACKGROUND ART

In general, a cooling module is mounted in a front end module carrier provided at a front side of a vehicle to cool an engine of the vehicle and cool an air conditioner refrigerant. The cooling module has a structure in which a condenser and a radiator are spaced apart from each other at a predetermined distance and stacked in parallel, and a fan shroud assembly is provided on one surface of the radiator, such that the condenser and the radiator perform heat exchange by means of a flow of air or an operation of a cooling fan while the vehicle travels.

FIG. 1 is a schematic view illustrating a cooling module in the related art.

For example, as illustrated in FIG. 1, the cooling module in the related art may be configured in a shape in which a condenser 30, a second radiator 21, a first radiator 11, and a fan shroud 40 are stacked and arranged in parallel in a direction from an upstream side toward a downstream side based on a flow direction of air. In this case, the first radiator 11 may be an engine radiator for cooling an engine, and the second radiator 21 may be an electrical component radiator for cooling electrical components. In addition, although not illustrated, an oil cooler for cooling transmission oil may be disposed at an upstream side of the condenser 30.

In the case of a recent engine that requires high heat dissipation performance, cooling performance is insufficiently achieved only by the single engine radiator. Therefore, an additional auxiliary radiator may be connected to improve cooling performance.

However, because the engine radiator in the related art only has a single inlet port and a single outlet port connected to an engine side, an additional structure is required to connect the engine radiator to a separate auxiliary radiator.

DOCUMENT OF RELATED ART

Patent Document

KR 10-2205847 B1 (Jan. 15, 2021)

DISCLOSURE

Technical Problem

The present invention has been made in an effort to solve the above-mentioned problem, and an object of the present invention is to provide a cooling module in which an additional coolant inlet/outlet port may be provided in an engine radiator in order to connect the engine radiator to an additional auxiliary radiator, and the auxiliary radiator may be applied to an engine that requires high heat dissipation performance, which may make it easy to connect the engine radiator and the auxiliary radiator by means of a coolant and improve performance in cooling the engine.

Technical Solution

In order to achieve the above-mentioned object, a cooling module of the present invention may include: a first radiator; and a second radiator stacked and disposed at an upstream side of the first radiator based on a flow direction of cooling air, in which the first radiator includes: a main inlet port connected to an engine so that a coolant is introduced through the main inlet port; a main discharge port through which the coolant is discharged; an auxiliary discharge port connected to a third radiator, which is installed at a position that does not overlap the first radiator and the second radiator in the flow direction of the cooling air, so that the coolant is discharged through the auxiliary discharge port; and an auxiliary inlet port through which the coolant is introduced, and in which the auxiliary discharge port and the auxiliary inlet port extends toward the third radiator.

In addition, the auxiliary inlet port and the auxiliary discharge port may extend toward an upstream side based on the flow direction of the cooling air, and the main inlet port and the main discharge port may extend toward a downstream side based on the flow direction of the cooling air.

In addition, the first radiator may include: a pair of header tanks disposed to be spaced apart from each other in a longitudinal direction; and a plurality of tubes each having two opposite ends connected to the pair of header tanks, the main inlet port and the auxiliary discharge port may be formed in any one of the pair of header tanks, and the main discharge port and the auxiliary inlet port may be formed in the other header tank.

In addition, the auxiliary inlet port and the auxiliary discharge port may be formed in shapes spread outward in the longitudinal direction from the first radiator toward an upstream side on the basis of the flow direction of the cooling air.

In addition, the auxiliary discharge port may be disposed below the main inlet port in a height direction.

In addition, the main inlet port and the auxiliary discharge port may be disposed adjacent to each other at an upper side based on a gravitational direction.

In addition, the auxiliary inlet port may be disposed above the main discharge port in the height direction.

In addition, the cooling module may further include: a condenser stacked and disposed at an upstream side of the second radiator based on the flow direction of the cooling air, in which the auxiliary discharge port or the auxiliary inlet port is disposed at a position corresponding to a refrigerant inlet pipe and a refrigerant outlet pipe of the condenser and disposed outward of the refrigerant inlet pipe and the refrigerant outlet pipe of the condenser in the longitudinal direction.

In addition, the cooling module may further include: an oil cooler stacked and disposed at an upstream side of the condenser based on the flow direction of the cooling air, in which the auxiliary discharge port or the auxiliary inlet port is disposed at a position corresponding to an oil inlet pipe and an oil outlet pipe of the oil cooler and disposed outward of the oil inlet pipe and the oil outlet pipe of the oil cooler in the longitudinal direction.

In addition, the auxiliary discharge port may be disposed adjacent to the main inlet port.

In addition, an inlet pipe and an outlet pipe may extend from the second radiator toward a downstream side based on the flow direction of the cooling air, a concave insertion groove may be formed in any one or more of the pair of header tanks of the first radiator, and the inlet pipe and the outlet pipe may be inserted and disposed in the insertion groove.

In addition, the cooling module may further include: at least one third radiator connected to the auxiliary discharge port and the auxiliary inlet port of the first radiator.

In addition, the cooling module may further include: a fan shroud stacked and disposed at a downstream side of the first radiator based on the flow direction of the cooling air.

Further, an engine radiator of the present invention may include: a pair of header tanks disposed adjacent to each other in a longitudinal direction; a plurality of tubes each having two opposite ends connected to the pair of header tanks; a main inlet port and an auxiliary inlet port formed in any one of the pair of header tanks so that a coolant is introduced through the main inlet port and the auxiliary inlet port; and a main discharge port and an auxiliary discharge port formed in any one of the pair of header tanks so that the coolant is discharged through the main discharge port and the auxiliary discharge port.

In addition, the main inlet port and the auxiliary discharge port may be formed in any one of the pair of header tanks, and the main discharge port and the auxiliary inlet port may be formed in the other header tank.

In addition, the auxiliary inlet port and the auxiliary discharge port may extend toward an upstream side based on a flow direction of cooling air, and the main inlet port and the main discharge port may extend toward a downstream side based on the flow direction of the cooling air.

In addition, the auxiliary inlet port and the auxiliary discharge port may be formed in shapes spread outward in a longitudinal direction toward an upstream side based on the flow direction of the cooling air.

In addition, the auxiliary discharge port may be disposed below the main inlet port in a height direction.

In addition, the main inlet port and the auxiliary discharge port may be disposed adjacent to each other at an upper side based on a gravitational direction.

In addition, the auxiliary inlet port may be disposed above the main discharge port in the height direction.

Advantageous Effects

According to the cooling module of the present invention, the engine radiator and the separate auxiliary radiator may be easily connected by means of the coolant and the performance in cooling the engine may be improved.

In addition, the interference between the coolant inlet/outlet port of the engine radiator and the other heat exchangers may be prevented at the time of configuring the cooling module by stacking the heat exchangers, such that the cooling module may be easily configured.

MODE FOR INVENTION

Hereinafter, a cooling module of the present invention configured as described above will be described in detail with reference to the accompanying drawings.

Figure 1:
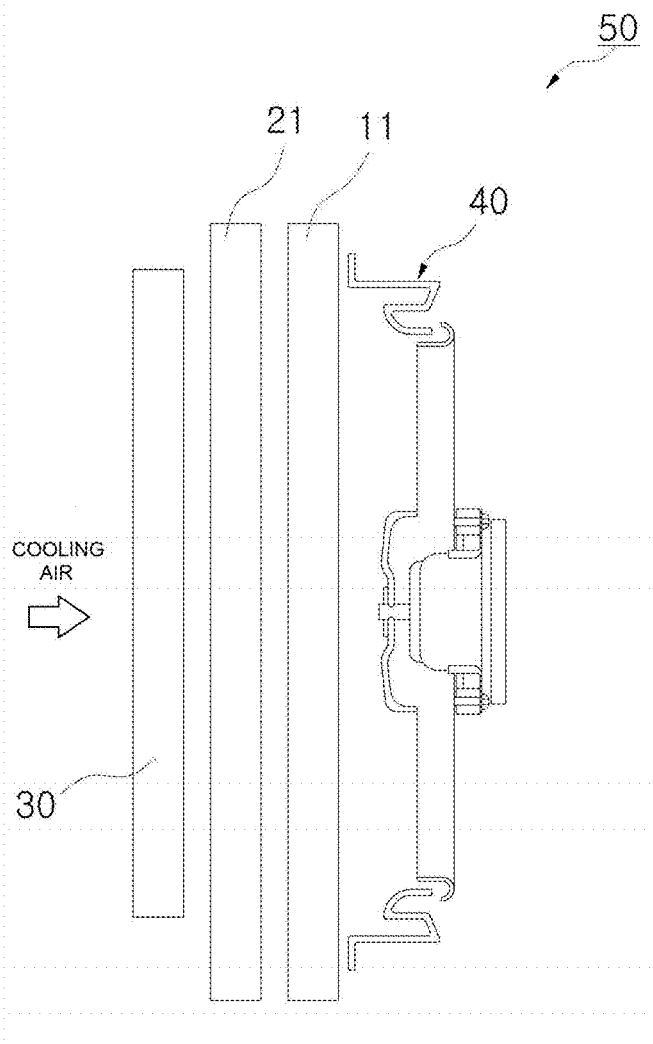
FIG. 1 is a schematic view illustrating a cooling module in the related art.
Figure 2:
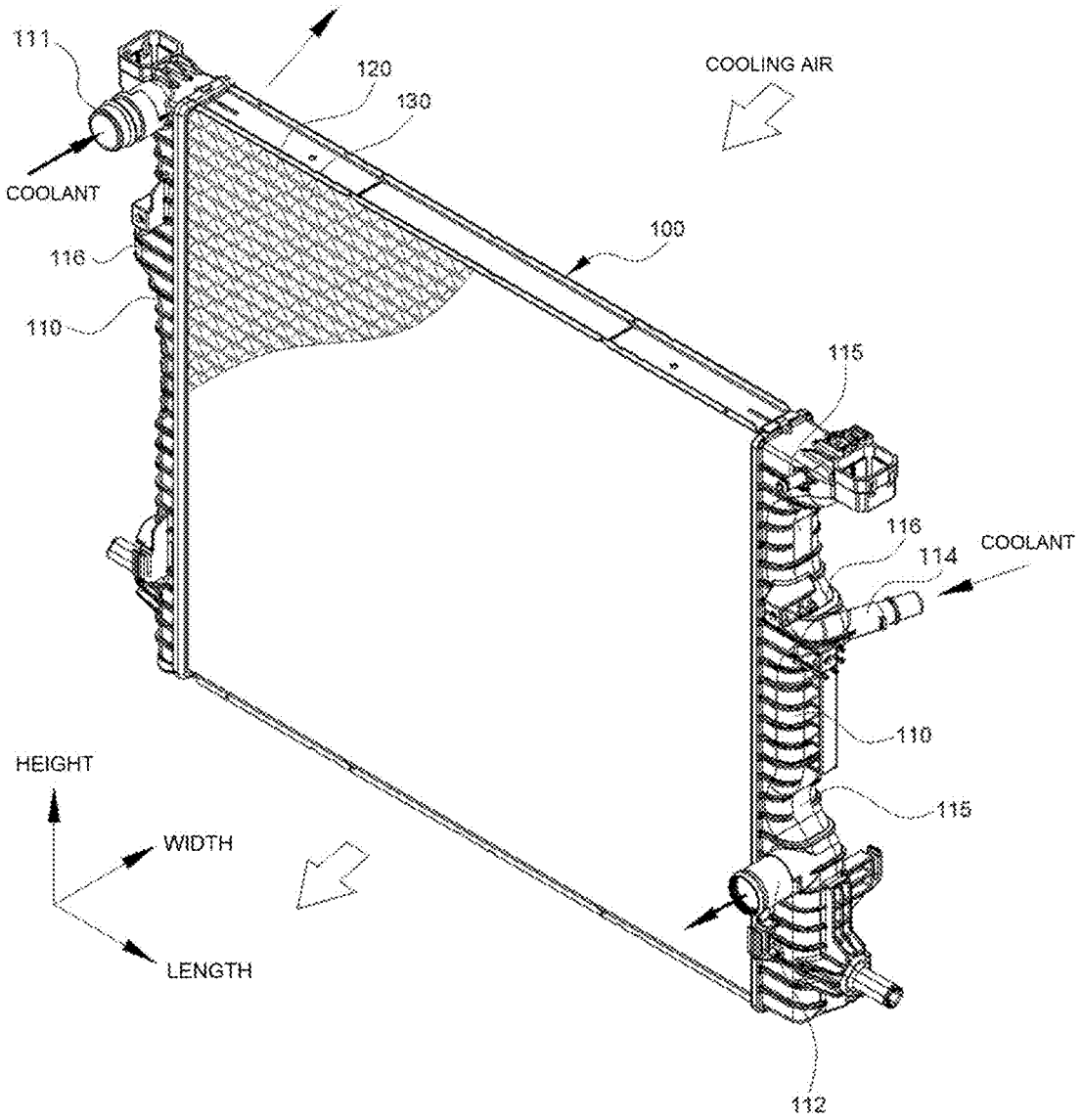
FIGS. 2 to 5 are perspective views, front views, and top plan views illustrating an engine radiator of a cooling module according to an embodiment of the present invention.
Figure 3:
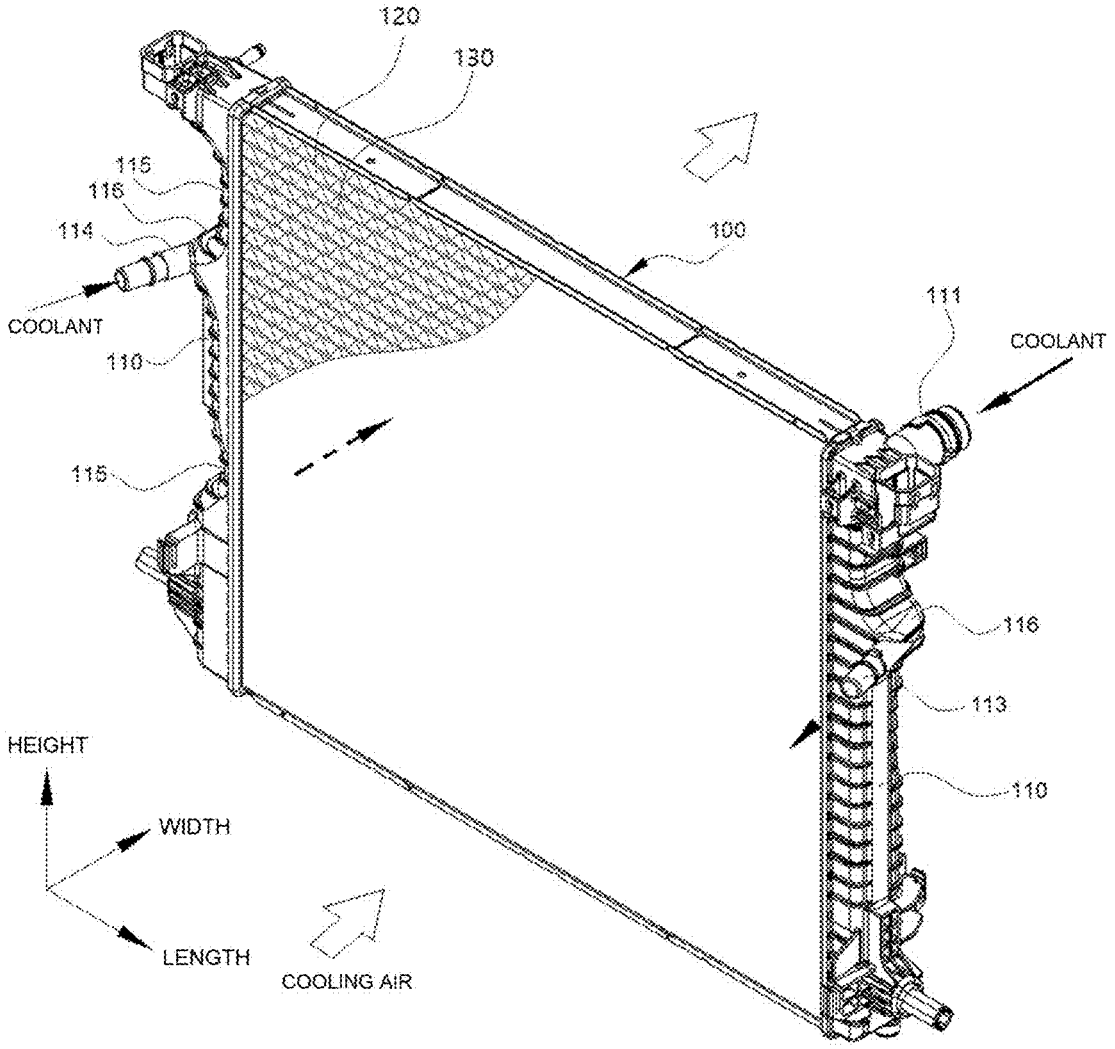
Figure 4:
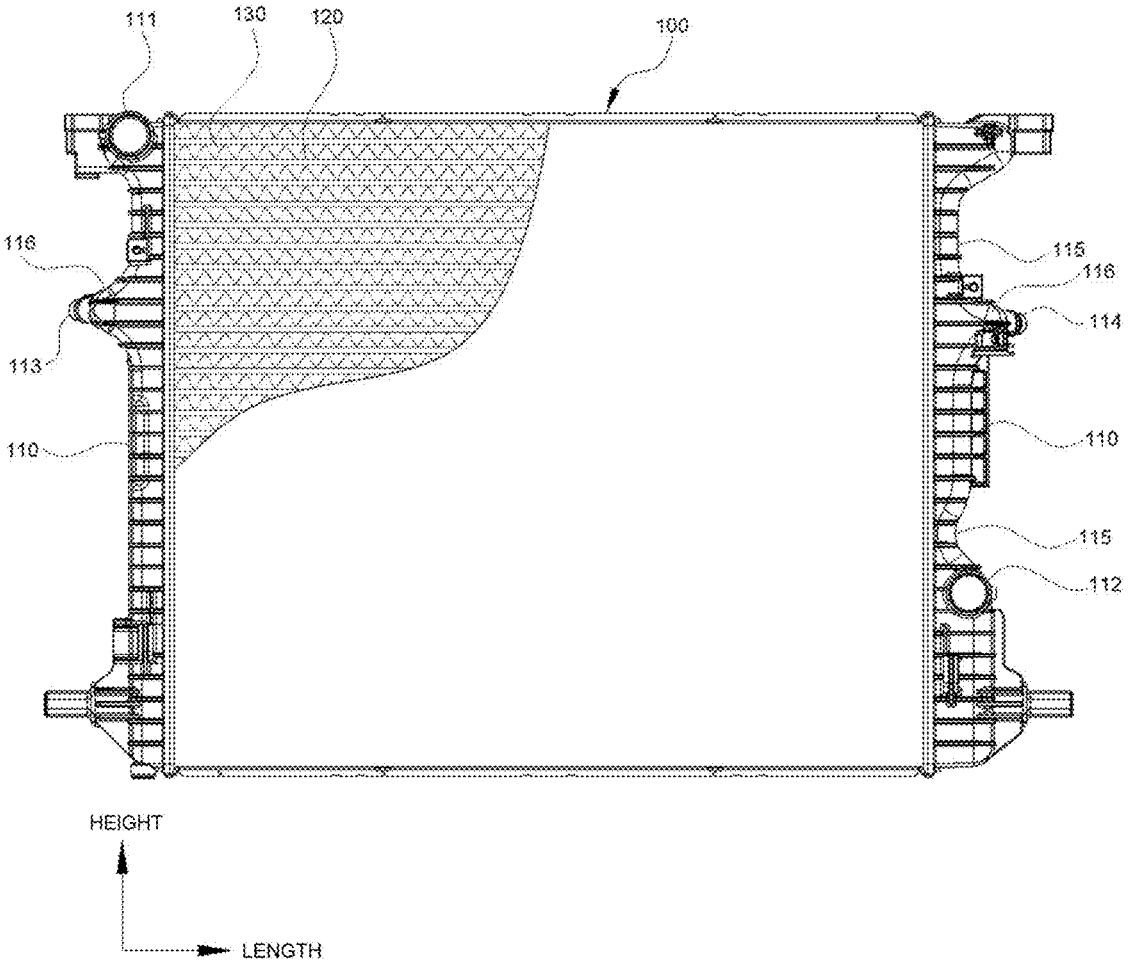
Figure 5:
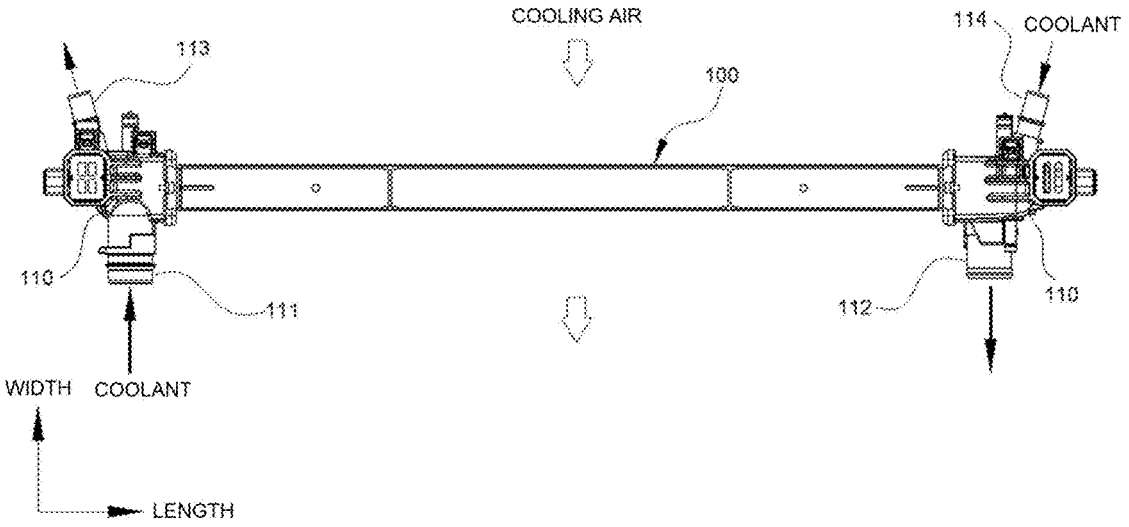
Figure 6:
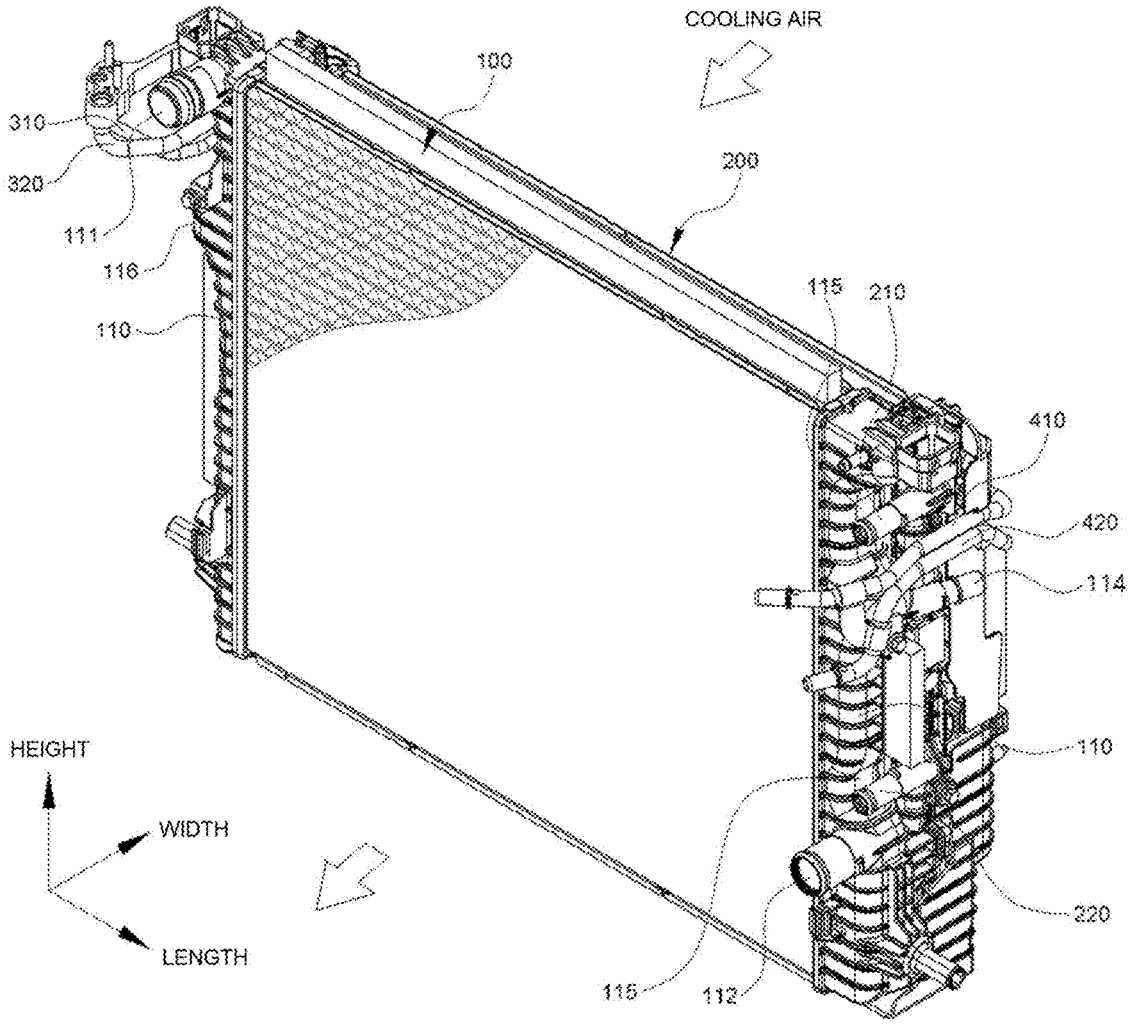
FIGS. 6 to 11 are assembled perspective views, front views, top plan views, and side views illustrating the cooling module according to the embodiment of the present invention.
Figure 7:
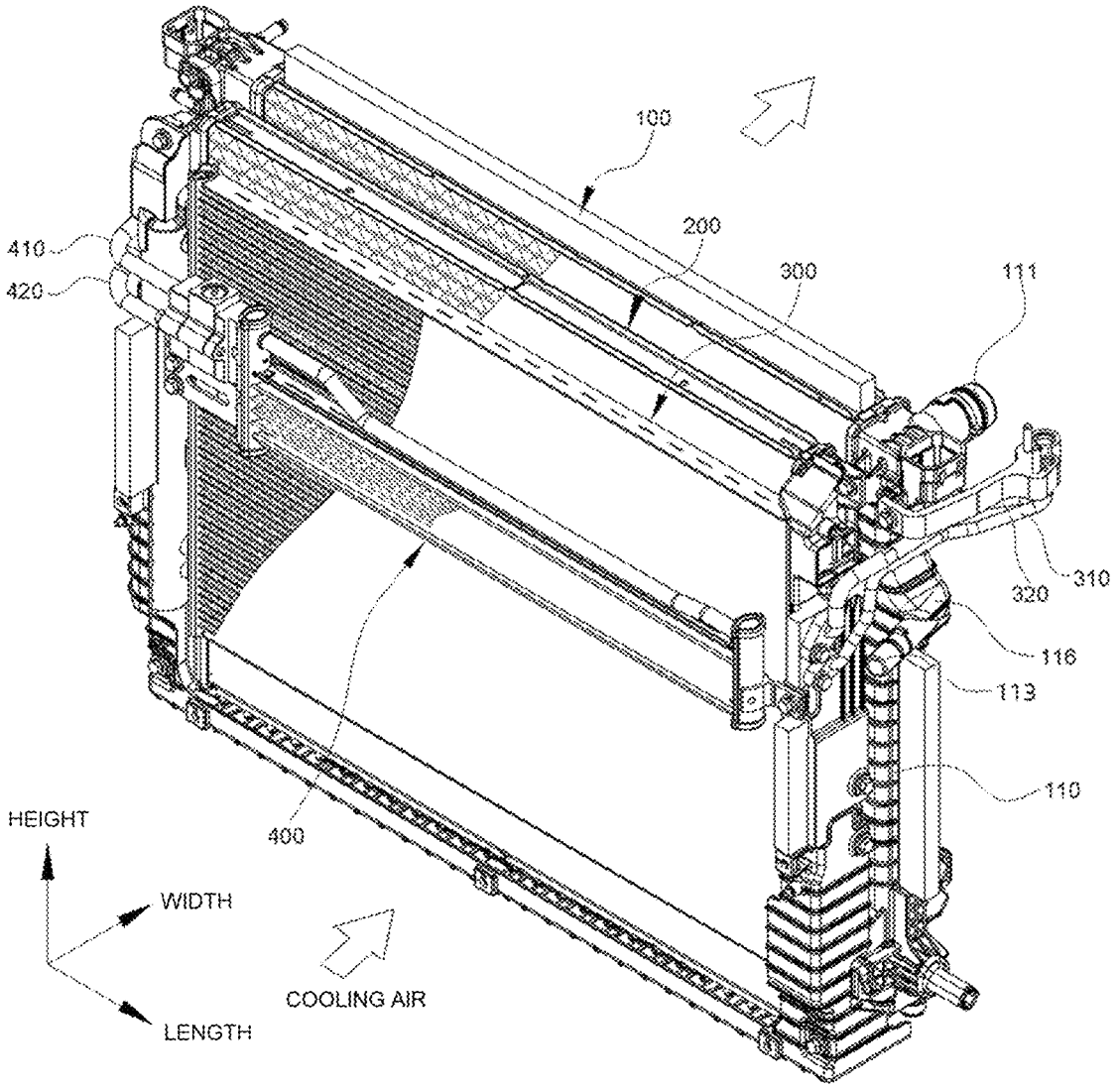
Figure 8:
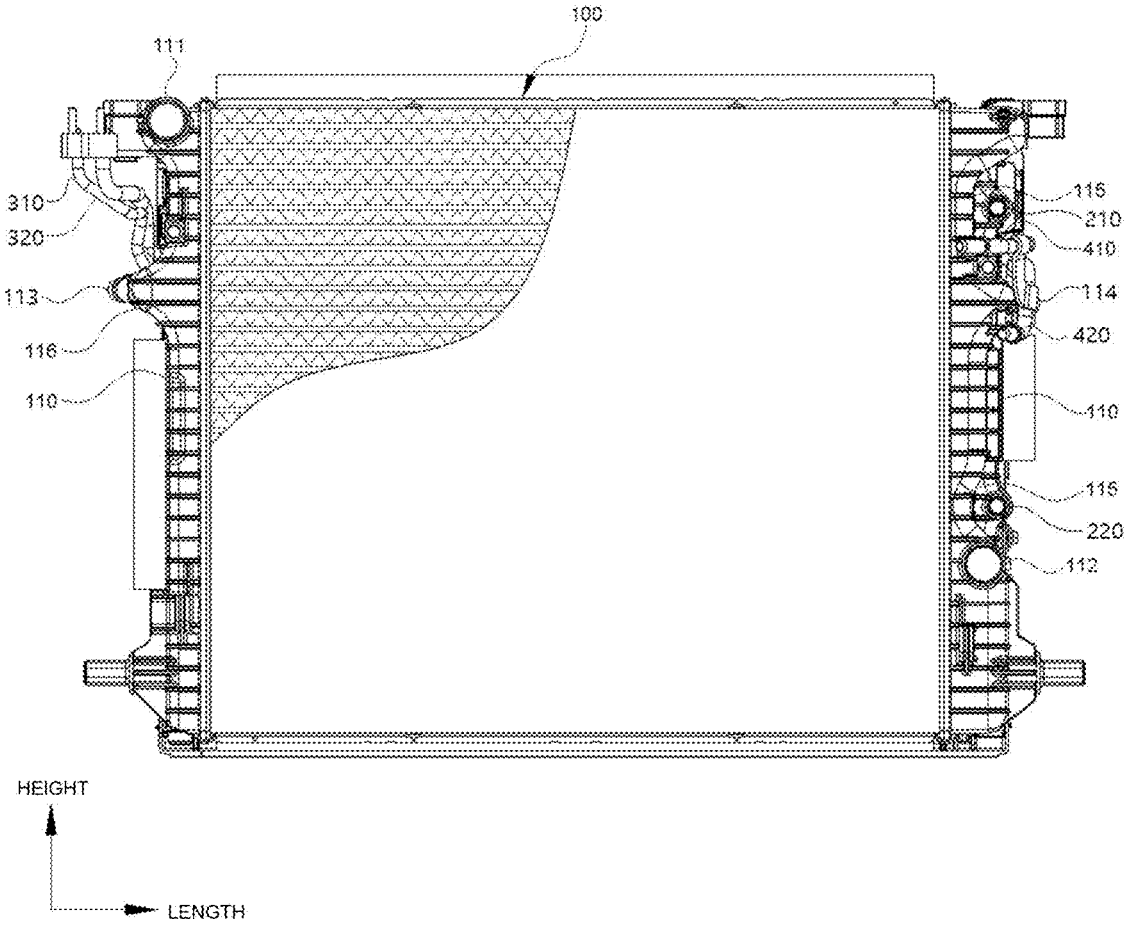
Figure 9:
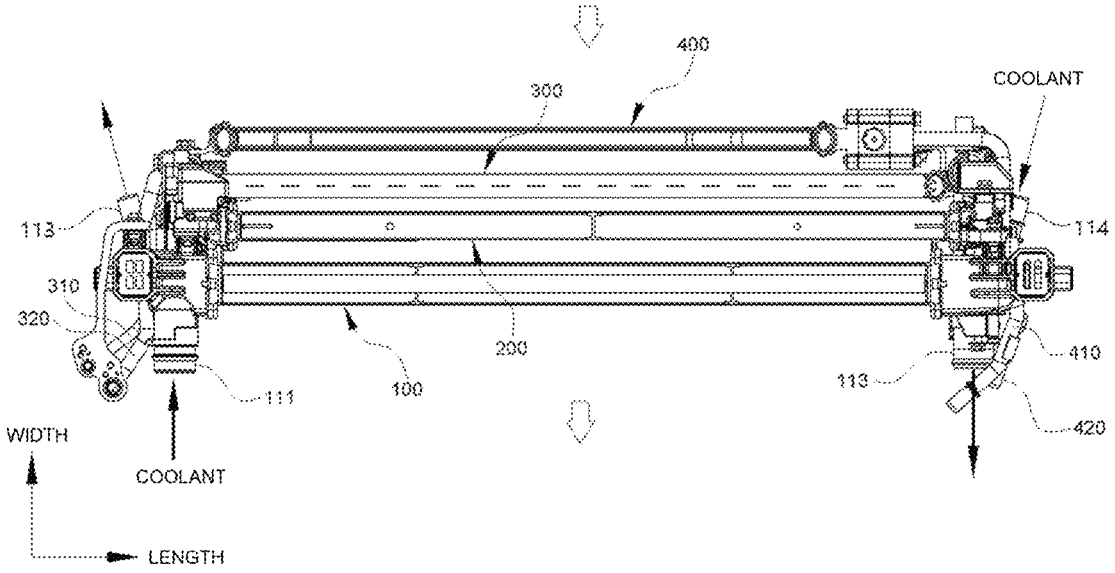
Figure 10:
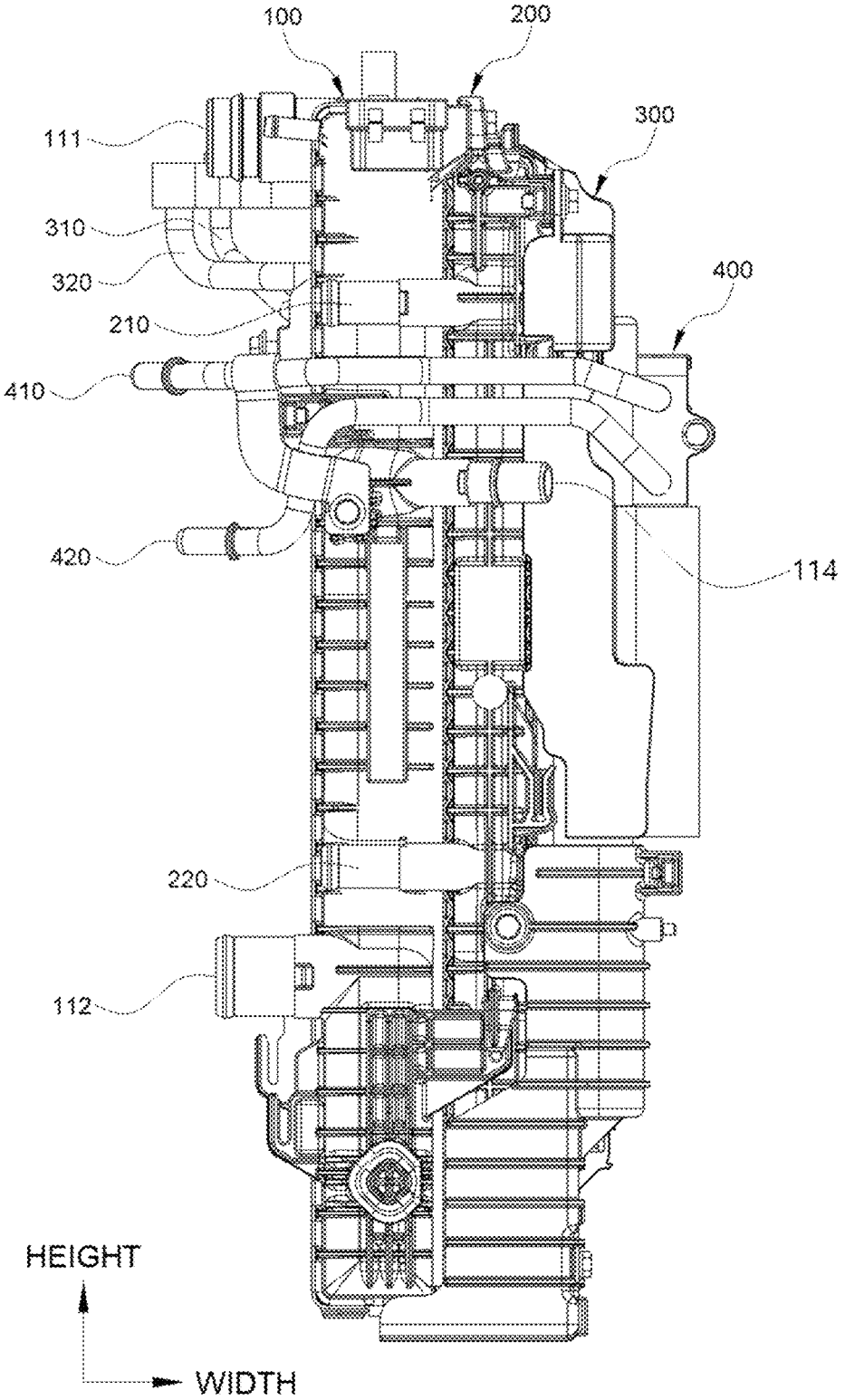
Figure 11:
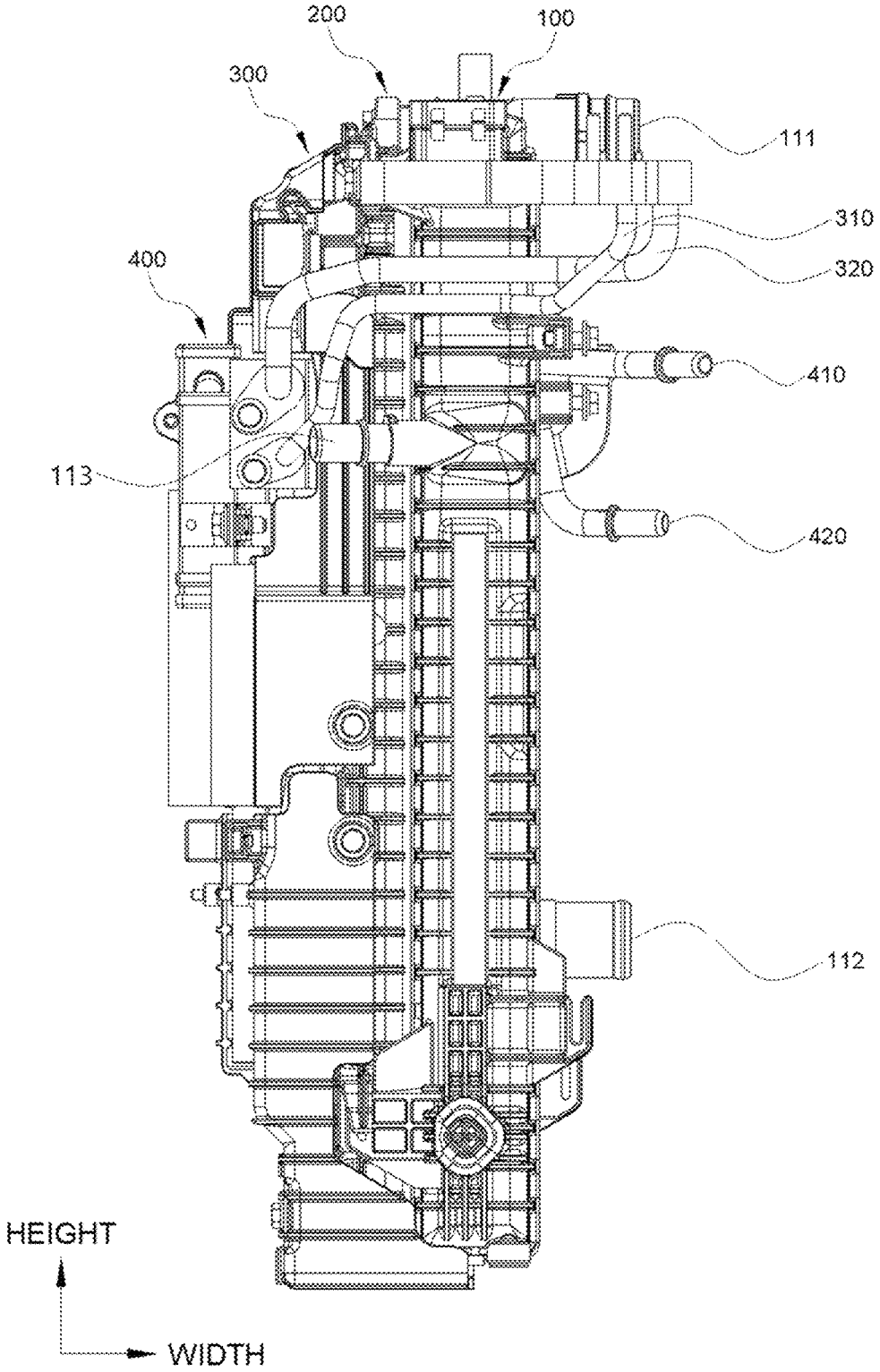

FIGS. 2 to 5 are perspective views, front views, and top plan views illustrating an engine radiator of a cooling module according to an embodiment of the present invention, and FIGS. 6 to 11 are assembled perspective views, front views, top plan views, and side views illustrating the cooling module according to the embodiment of the present invention.

As illustrated, the cooling module of the present invention may broadly include a first radiator 100, a second radiator 200, a condenser 300, and an oil cooler 400, and cooling air may flow in a direction from the oil cooler 400 toward the first radiator 100.

The first radiator 100 may be an engine radiator 100. The engine radiator 100 may be connected to an engine of a vehicle, and a coolant may circulate through the engine radiator 100. The engine radiator 100 may serve to cool the coolant.

The second radiator 200 may be an electrical component radiator 200. The electrical component radiator 200 may be stacked and disposed at an upstream side of the engine radiator 100 based on a width direction, i.e., a flow direction of the cooling air. The electrical component radiator 200 may be fixedly coupled to the engine radiator 100. The electrical component radiator 200 may be connected to electrical components, such as a motor or an inverter of the vehicle, that generates heat, and the coolant may circulate through the electrical component radiator 200. The electrical component radiator 200 may serve to cool the coolant.

The condenser 300 may be stacked and disposed at an upstream side of the electrical component radiator 200 based on the width direction, i.e., the flow direction of the cooling air. The condenser 300 may be fixedly coupled to the electrical component radiator 200. The condenser 300 may be connected to an air conditioner system of the vehicle, and a refrigerant may circulate through the condenser 300. The condenser 300 may serve to convert a gaseous refrigerant into a liquid refrigerant by cooling and condensing the gaseous refrigerant.

The oil cooler 400 may be stacked and disposed at an upstream side of the condenser 300 based on the width direction, i.e., the flow direction of the cooling air. The oil cooler 400 may be fixedly coupled to the condenser 300. The oil cooler 400 may be connected to a transmission of the vehicle, and transmission oil may circulate through the oil cooler 400. The oil cooler 400 may serve to cool the transmission oil.

Further, although not illustrated, a fan shroud may be stacked and disposed at a downstream side of the engine radiator 100 based on the width direction, i.e., the flow direction of the cooling air. The fan shroud may be fixedly coupled to the engine radiator 100. The fan shroud may serve to operate a fan and forcibly pump the cooling air so that the cooling air passes through heat exchangers. In addition, a third radiator, which is an auxiliary radiator, may be installed at a position that does not overlap the engine radiator 100, the electrical component radiator 200, the condenser 300, and the oil cooler 400 in the flow direction of the cooling air. That is, the third radiator is not disposed in a flow path for the cooling air that passes through the engine radiator 100, the electrical component radiator 200, the condenser 300, and the oil cooler 400, but the third radiator may be disposed at a position spaced apart from the engine radiator 100, the electrical component radiator 200, the condenser 300, and the oil cooler 400. In addition, the third radiator may be separately installed outside an assembly made by coupling the engine radiator 100, the electrical component radiator 200, the condenser 300, and the oil cooler 400.

In this case, the engine radiator 100 may include a pair of header tanks 110 and a plurality of tubes 120 and further include a plurality of fins 130. The pair of header tanks 110 may be spaced apart from each other in a longitudinal direction and disposed in parallel. The plurality of tubes 120 may each have two opposite ends connected to the pair of header tanks 110, and the plurality of tubes 120 may communicate with the pair of header tanks 110. Further, for example, a main inlet port 111, through which the coolant is introduced, may be formed in one of the pair of header tanks 110, and a main discharge port 112, through which the coolant is discharged, may be formed in the other header tank. In addition, an auxiliary discharge port 113 may be formed in the header tank having the main inlet port 111, and an auxiliary inlet port 114 may be formed in the header tank having the main discharge port 112.

Therefore, when the coolant is introduced into one header tank 110 through the main inlet port 111 from the engine, the coolant may flow to the other header tank 110 through the plurality of tubes 120. In this case, a part of the coolant may flow to the third radiator through the auxiliary discharge port 113, be introduced into the other header tank 110 through the auxiliary inlet port 114, and then sent back to the engine through the main discharge port 112. In addition, the auxiliary inlet port 114 and the auxiliary discharge port 113 may extend toward the upstream side based on the flow direction of the cooling air, and the main inlet port 111 and the main discharge port 112 may extend toward the downstream side based on the flow direction of the cooling air. Therefore, the auxiliary inlet port 114 and the auxiliary discharge port 113 may be easily connected to the third radiator that may be disposed at the front side of the vehicle. The main inlet port 111 and the main discharge port 112 may be easily connected to the engine that may be disposed at the downstream side of the cooling module based on the flow direction of the cooling air. In addition, the cooling module of the present invention may connect the engine radiator and the separate auxiliary radiator in parallel and cool the coolant to improve cooling performance. Therefore, the cooling module may be applied to the engine that requires high heat dissipation performance. That is, because the coolant, which is introduced into one header tank of the engine radiator 100 through the main inlet port 111 from the engine side, flows to the auxiliary radiator through the auxiliary discharge port 113 of the header tank at the same side, which makes it advantageous to improve the heat exchange performance of the auxiliary radiator. Further, the main inlet port 111 and the auxiliary discharge port 113 may be formed to be adjacent to each other, which may further improve the heat exchange performance of the auxiliary radiator. If the main inlet port 111 and the auxiliary discharge port 113 are spaced apart from each other in the longitudinal direction of the header tank or formed at different header tank sides, a part of the coolant flows to the auxiliary radiator after performing heat exchange in the engine radiator 100, which is disadvantageous in ensuring the heat exchange performance of the auxiliary radiator. Further, the main inlet port 111 and the auxiliary discharge port 113 may be disposed adjacent to each other and positioned at the upper side based on the gravitational direction, such that the coolant may easily flow by gravity.

In addition, the auxiliary inlet port 114 and the auxiliary discharge port 113 may be formed in shapes spread outward in the longitudinal direction from the engine radiator 100 toward the upstream side based on the flow direction of the cooling air. Therefore, it is possible to prevent the auxiliary inlet port 114 and the auxiliary discharge port 113 from interfering with the electrical component radiator 200, the condenser 300, and the oil cooler 400 disposed to be closer to the upstream side based on the flow direction of the cooling air than the engine radiator 100. In addition, interference may be prevented, and the pipes connected to the third radiator and the auxiliary discharge port 113 and the auxiliary inlet port 114 of the engine radiator are less bent, such that lengths of the connection pipes may be reduced in comparison with a case in which the connection pipes are bent to a large degree.

In addition, the auxiliary discharge port 113 may be disposed below the main inlet port 111 based on a height direction (gravitational direction), and the auxiliary inlet port 114 may be disposed above the main discharge port 112 based on the height direction (gravitational direction). In this case, the auxiliary discharge port 113 and the auxiliary inlet port 114 may be disposed at the same height in the height direction. Therefore, the auxiliary inlet port 114 and the auxiliary discharge port 113 are disposed so that the coolant passing through the engine radiator 100 via the main inlet port 111 is divided in the flow paths branching off from the main discharge port 112 and merged again, such that the coolant may flow more smoothly.

In addition, the auxiliary discharge port 113 and the auxiliary inlet port 114 may protrude in the longitudinal direction from the header tanks 110 in which the auxiliary discharge port 113 and the auxiliary inlet port 114 are respectively formed. As illustrated, a protruding portion 116 may be formed in the longitudinal direction in the header tank 110 based on an outer surface of the header tank 110 based on the longitudinal direction of the engine radiator 100, and the auxiliary discharge port 113 and the auxiliary inlet port 114 may be formed in shapes extending from the protruding portion 116. Therefore, it is possible to prevent the auxiliary inlet port 114 and the auxiliary discharge port 113 from interfering with the electrical component radiator 200, the condenser 300, and the oil cooler 400 disposed to be closer to the upstream side than the engine radiator 100.

In addition, the auxiliary discharge port 113 or the auxiliary inlet port 114 may be disposed at a position corresponding to a refrigerant inlet pipe 310 and a refrigerant outlet pipe 320 of the condenser 300 and disposed outward of the refrigerant inlet pipe 310 and the refrigerant outlet pipe 320 of the condenser 300 in the longitudinal direction. Therefore, it is possible to prevent the auxiliary inlet port 114 and the auxiliary discharge port 113 from interfering with the refrigerant inlet pipe 310 and the refrigerant outlet pipe 320 of the condenser 300.

Likewise, the auxiliary discharge port 113 or the auxiliary inlet port 114 may be disposed at a position corresponding to an oil inlet pipe 410 and an oil outlet pipe 420 of the oil cooler 400 and disposed outward of the oil inlet pipe 410 and the oil outlet pipe 420 of the oil cooler 400 in the longitudinal direction. Therefore, it is possible to prevent the auxiliary inlet port 114 and the auxiliary discharge port 113 from interfering with the oil inlet pipe 410 and the oil outlet pipe 420 of the oil cooler 400.

In addition, the auxiliary discharge port 113 may be disposed adjacent to the main inlet port 111. Therefore, the coolant, which is introduced into the header tank 110 through the main inlet port 111, may easily flow to the separate auxiliary radiator not only through the plurality of tubes 120 but also through the auxiliary discharge port 113.

In addition, an inlet pipe 210 and an outlet pipe 220 may extend from the electrical component radiator 200 toward the downstream side based on the flow direction of the cooling air, and a concave insertion groove 115 is formed in any one or more of the pair of header tanks 110 of the engine radiator 100, such that the inlet pipe 210 and the outlet pipe 220 of the electrical component radiator 200 may be disposed and inserted into the insertion groove 115. Therefore, the cooling module may be configured more compactly.

In addition, as described above, the cooling module of the present invention may further include at least one separate auxiliary radiator connected to the auxiliary discharge port 113 and the auxiliary inlet port 114 of the engine radiator 100. The cooling module may further include the fan shroud stacked at the downstream side of the engine radiator 100 based on the flow direction of the cooling air.

The present invention is not limited to the above-mentioned embodiments, and the scope of application is diverse. Of course, various modifications and implementations made by any person skilled in the art to which the present invention pertains without departing from the subject matter of the present invention claimed in the claims.

DESCRIPTION OF REFERENCE NUMERALS

100: First radiator (engine radiator), 110: Header tank,
111: Main inlet port, 112: Main discharge port,
113: Auxiliary discharge port, 114: Auxiliary inlet port,
115: Insertion groove, 116: Protruding portion, 120: Tube, 130: Fin,
200: Second radiator (electrical component radiator), 210: Inlet pipe,
220: Outlet pipe, 300: Condenser,
310: Refrigerant inlet pipe, 320: Refrigerant outlet pipe,
400: Oil cooler, 410: Oil inlet pipe,
420: Oil outlet pipe.

The invention claimed is:

1. A cooling module comprising:
a first radiator; and
a second radiator stacked and disposed at an upstream side of the first radiator based on a flow direction of cooling air,
wherein the first radiator comprises:
a main inlet port connected to an engine so that a coolant is introduced through the main inlet port;
a main discharge port through which the coolant is discharged;
an auxiliary discharge port connected to a third radiator, which is installed at a position that does not overlap the first radiator and the second radiator in the flow direction of the cooling air, so that the coolant is discharged through the auxiliary discharge port;
an auxiliary inlet port through which the coolant is introduced;
a pair of header tanks disposed to be spaced apart from each other in a longitudinal direction; and
a plurality of tubes each having two opposite ends connected to the pair of header tanks,
wherein the auxiliary discharge port and the auxiliary inlet port each extend toward the third radiator, and
wherein the main inlet port and the auxiliary discharge port are formed in any one of the pair of header tanks, and the main discharge port and the auxiliary inlet port are formed in the other header tank.

2. The cooling module of claim 1, wherein the auxiliary inlet port and the auxiliary discharge port extend toward an upstream side based on the flow direction of the cooling air, and the main inlet port and the main discharge port extend toward a downstream side based on the flow direction of the cooling air.

3. The cooling module of claim 1, wherein the auxiliary inlet port and the auxiliary discharge port are formed in shapes spread outward in the longitudinal direction from the first radiator toward an upstream side on the basis of the flow direction of the cooling air.

4. The cooling module of claim 1, wherein the auxiliary discharge port is disposed below the main inlet port in a height direction.

5. The cooling module of claim 4, wherein the main inlet port and the auxiliary discharge port are disposed adjacent to each other at an upper side based on a gravitational direction.

6. The cooling module of claim 1, wherein the auxiliary inlet port is disposed above the main discharge port in the height direction.

7. The cooling module of claim 1, further comprising:
a condenser stacked and disposed at an upstream side of the second radiator based on the flow direction of the cooling air,
wherein the auxiliary discharge port or the auxiliary inlet port is disposed at a position corresponding to a refrigerant inlet pipe and a refrigerant outlet pipe of the condenser and disposed outward of the refrigerant inlet pipe and the refrigerant outlet pipe of the condenser in the longitudinal direction.

8. The cooling module of claim 7, further comprising:
an oil cooler stacked and disposed at an upstream side of the condenser based on the flow direction of the cooling air,
wherein the auxiliary discharge port or the auxiliary inlet port is disposed at a position corresponding to an oil inlet pipe and an oil outlet pipe of the oil cooler and disposed outward of the oil inlet pipe and the oil outlet pipe of the oil cooler in the longitudinal direction.

9. The cooling module of claim 1, wherein the auxiliary discharge port is disposed adjacent to the main inlet port.

10. The cooling module of claim 1, wherein an inlet pipe and an outlet pipe extend from the second radiator toward a downstream side based on the flow direction of the cooling air, and wherein a concave insertion groove is formed in any one or more of the pair of header tanks of the first radiator, and the inlet pipe and the outlet pipe are inserted and disposed in the insertion groove.

11. The cooling module of claim 1, wherein the third radiator is connected to the auxiliary discharge port and the auxiliary inlet port of the first radiator.

12. The cooling module of claim 1, further comprising:
a fan shroud stacked and disposed at a downstream side of the first radiator based on the flow direction of the cooling air.

13. An engine radiator comprising:
a pair of header tanks disposed adjacent to each other in a longitudinal direction;

a plurality of tubes each having two opposite ends connected to the pair of header tanks;

a main inlet port and an auxiliary inlet port formed in any one of the pair of header tanks so that a coolant is introduced through the main inlet port and the auxiliary inlet port; and a main discharge port and an auxiliary discharge port formed in any one of the pair of header tanks so that the coolant is discharged through the main discharge port and the auxiliary discharge port, wherein the auxiliary discharge port and the main inlet port are formed in the same one-sided header tank, and the auxiliary inlet port and the main discharge port are formed in the same other-sided header tank.

14. The engine radiator of claim 13, wherein the main inlet port and the auxiliary discharge port are formed in any one of the pair of header tanks, and the main discharge port and the auxiliary inlet port are formed in the other header tank.

15. The engine radiator of claim 13, wherein the auxiliary inlet port and the auxiliary discharge port extend toward an upstream side based on a flow direction of cooling air, and the main inlet port and the main discharge port extend toward a downstream side based on the flow direction of the cooling air.

16. The engine radiator of claim 15, wherein the auxiliary inlet port and the auxiliary discharge port are formed in shapes spread outward in a longitudinal direction toward an upstream side based on the flow direction of the cooling air.

17. The engine radiator of claim 14, wherein the auxiliary discharge port is disposed below the main inlet port in a height direction.

18. The engine radiator of claim 17, wherein the main inlet port and the auxiliary discharge port are disposed adjacent to each other at an upper side based on a gravitational direction.

19. The engine radiator of claim 14, wherein the auxiliary inlet port is disposed above the main discharge port in a height direction.

* * * * *